US009586796B1

(12) United States Patent
Brand

(10) Patent No.: US 9,586,796 B1
(45) Date of Patent: Mar. 7, 2017

(54) AXLE LIFTING IMPLEMENT

(71) Applicant: Gordon Earl Brand, Aguanga, CA (US)

(72) Inventor: Gordon Earl Brand, Aguanga, CA (US)

( * ) Notice: Subject to any disclaimer, the term of this patent is extended or adjusted under 35 U.S.C. 154(b) by 0 days.

(21) Appl. No.: 14/630,155

(22) Filed: Feb. 24, 2015

Related U.S. Application Data

(60) Provisional application No. 61/944,921, filed on Feb. 26, 2014.

(51) Int. Cl.
*B66F 3/00* (2006.01)

(52) U.S. Cl.
CPC ..... *B66F 3/005* (2013.01)

(58) Field of Classification Search
CPC ..... B66F 3/005; B60S 9/04; B60T 3/00
See application file for complete search history.

(56) References Cited

U.S. PATENT DOCUMENTS 1,549,479 A * 8/1925 Flower ..... B66F 3/005 254/94
1,682,856 A * 9/1928 Salkind ..... B60S 9/04 248/352
3,298,665 A * 1/1967 Sieloff ..... B66F 3/005 254/94
4,034,961 A * 7/1977 Breen ..... B60T 3/00 188/32
5,615,863 A * 4/1997 Bailey ..... B66F 3/005 254/94
5,702,089 A * 12/1997 Hurd ..... B60S 9/04 254/422

* cited by examiner

*Primary Examiner* — Joseph J Hail
*Assistant Examiner* — Marc Carlson
(74) *Attorney, Agent, or Firm* — Plager Schack LLP

(57) ABSTRACT

An axle lifting implement lifts an axle from the ground. The axle lifting implement has a front side joined to a base resting point and an axle cradle. A first angular lift surface is joined to the base resting point and a second angular lift surface. A rear side is joined to the second angular lift surface and the axle cradle. In a first mode of operation, the axle cradle is immediately adjacent to the axle such that the second angular lift surface is on the ground. In a second mode of operation, the first angular lift surface and the base resting point are immediately adjacent to the ground and the axle is displaced the height from the ground further than the axle was displaced from the ground in the first mode of operation.

7 Claims, 4 Drawing Sheets

AXLE LIFTING IMPLEMENT

RELATED APPLICATION

This application claims priority to provisional patent application U.S. Ser. No. 61/944,921 filed on Feb. 26, 2014, the entire contents of which is herein incorporated by reference.

BACKGROUND

The embodiments herein relate generally to systems that lift an axle of a trailer.

Prior to embodiments of the disclosed invention, trailer tires supported the weight of a trailer and its contents. A trailer that rested on its tires for a period of time, may compromise the structural integrity of its tires. Embodiments of the disclosed invention solve this problem.

SUMMARY

An axle lifting implement can be configured to lift an axle a height from ground. The axle lifting implement has a front side joined to a base resting point and an axle cradle. A first angular lift surface can be joined to the base resting point and a second angular lift surface. A rear side can be joined to the second angular lift surface and the axle cradle. In a first mode of operation the axle cradle can be immediately adjacent to the axle such that the second angular lift surface is on the ground. In a second mode of operation the axle cradle can be immediately adjacent to the axle such that the first angular lift surface and the base resting point are immediately adjacent to the ground and the axle is displaced the height from the ground further than the axle was displaced from the ground in the first mode of operation.

In some embodiments, a first rounded portion can be joined to the front side. A second side can be joined to the first rounded portion. The base resting point can be joined to the second side.

In some embodiments, a base can connect the base resting point to the first angular lift surface. A relief base can connect the first angular lift surface to the second angular lift surface.

In some embodiments, the axle lifting implement has an internal support frame that includes a first member which joins the front side to the axle cradle. A second member can join the rear side to the axle cradle. A third member can join the front side to an upper central joint.

In some embodiments, the internal support frame can also include a fourth member which can join the axle cradle to the upper central joint. A fifth member can join the rear side to the upper central joint. A sixth member can join the first rounded portion to the upper central joint.

In some embodiments, the internal support frame can also include a seventh member which can join the upper central joint to a lower central joint. An eighth member can join the upper central joint to a relief base slot. The relief base slot can be filled with the second angular lift surface. A ninth member can join the first rounded portion to the base. A tenth member can join the first rounded portion to a base slot. The base slot can be filled with the first angular lift surface.

In some embodiments, the internal support frame can also include an eleventh member which can join the first rounded portion to the lower central joint. A twelfth member which can join the lower central joint to the base slot. A thirteenth member which can join the lower central joint to the relief base slot.

In some embodiments, the first angular lift surface can further comprise a first anti-slip ribbing. The second angular lift surface can further comprises a second anti-slip ribbing.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
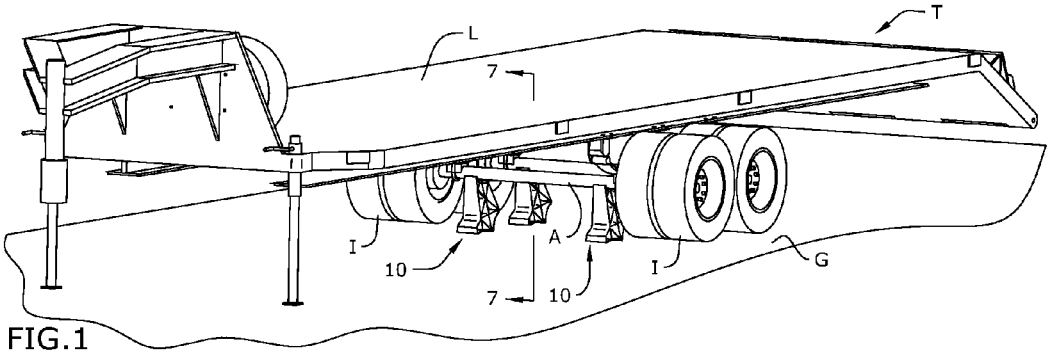
FIG. 1 is a perspective view of the invention shown in use in an exemplary configuration.
Figure 2:
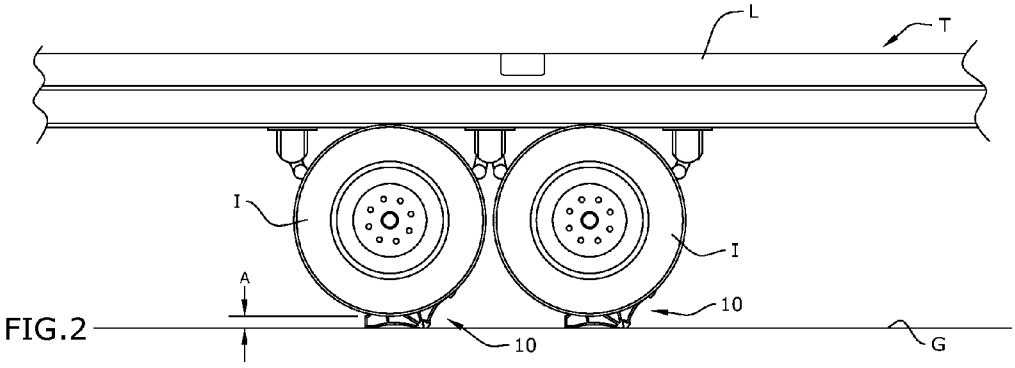
FIG. 2 is a side view of the invention shown in use in an exemplary configuration demonstrating ground clearance distance A.
Figure 3:
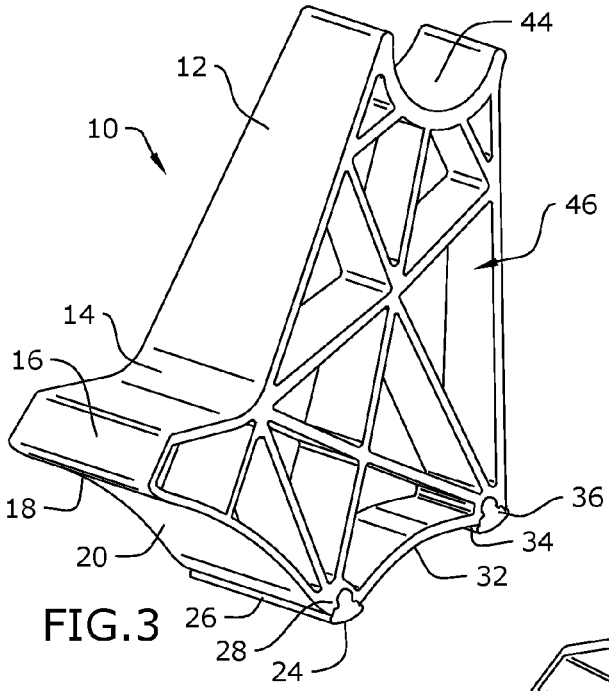
FIG. 3 is a top front perspective view of the invention.
Figure 4:
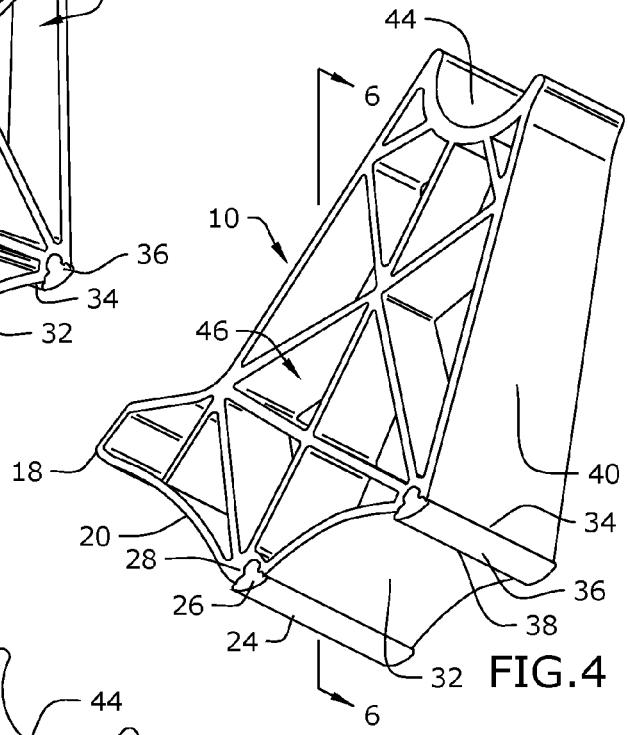
FIG. 4 is a bottom rear perspective view of the invention.
Figure 5:
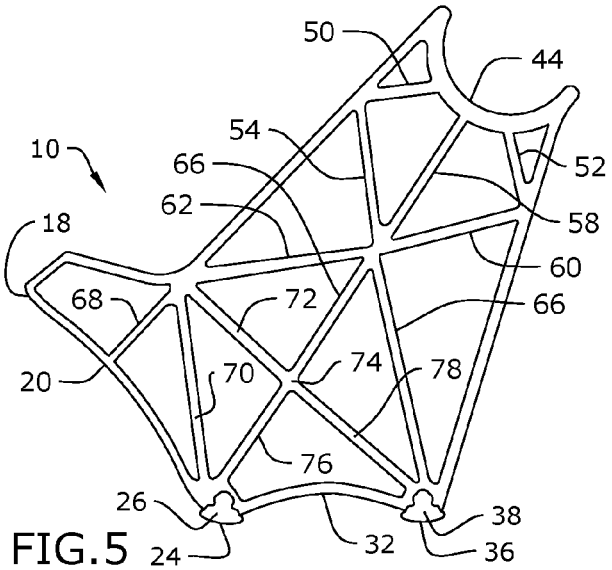
FIG. 5 is a side view of the invention.
Figure 6:
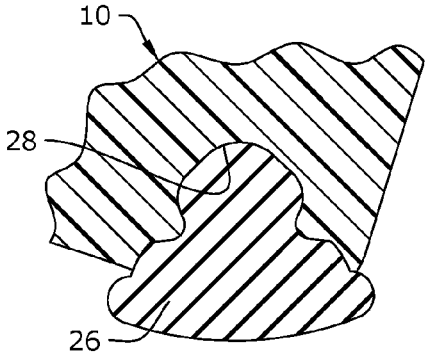
FIG. 6 is a section detail view of the invention along line 6-6 in FIG. 4.
Figure 7:
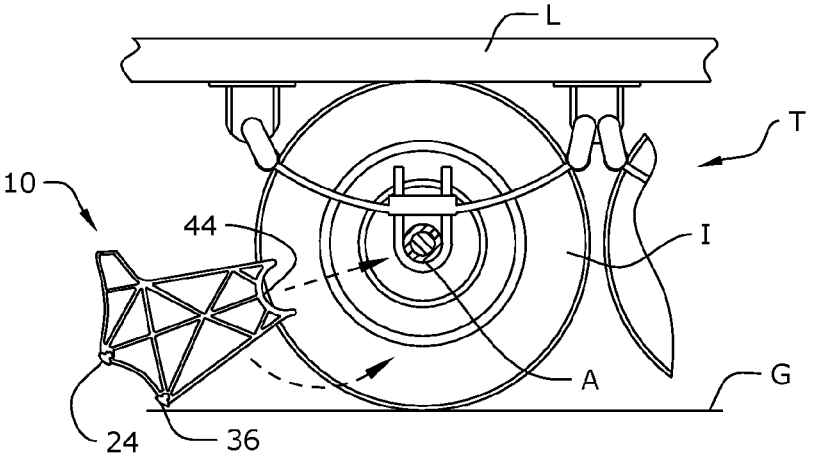
FIG. 7 is a section-detail/exploded view of the invention along line 7-7 in FIG. 1 demonstrating application.
Figure 8:
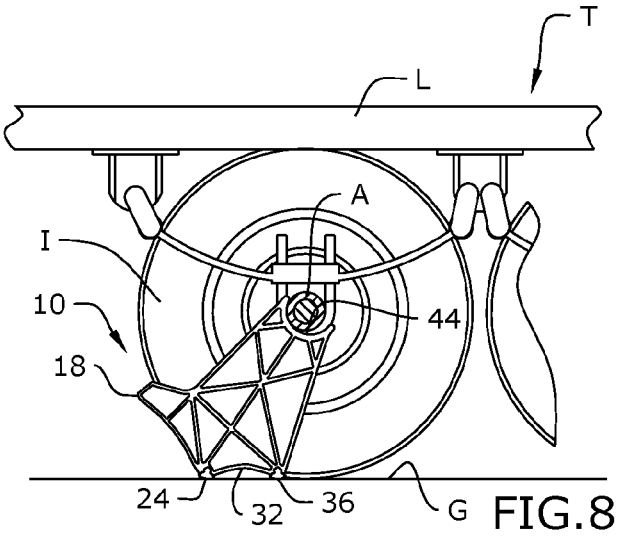
FIG. 8 is a section-detail view of the invention demonstrated post application.
Figure 9:
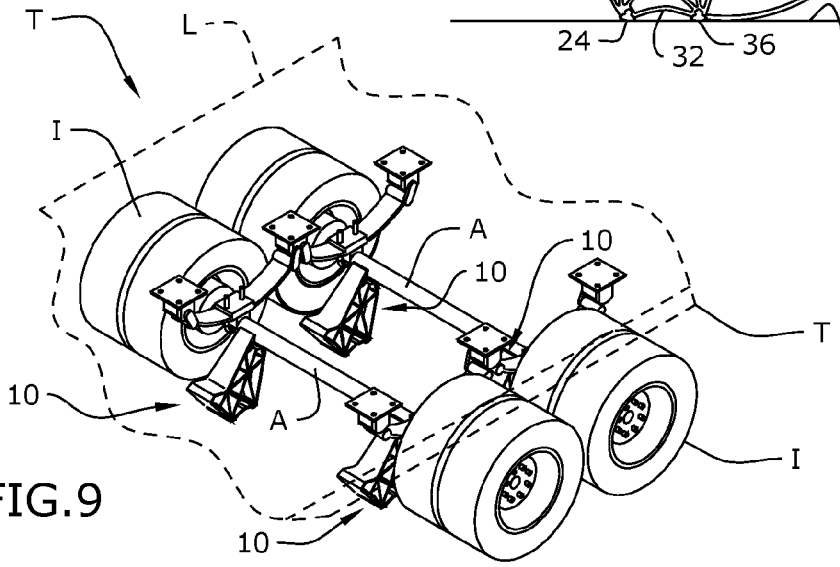
FIG. 9 is a top detail perspective of the invention shown applied to multiple axles with the exemplary load/weight shown in hidden for illustrative clarity.
Figure 10:
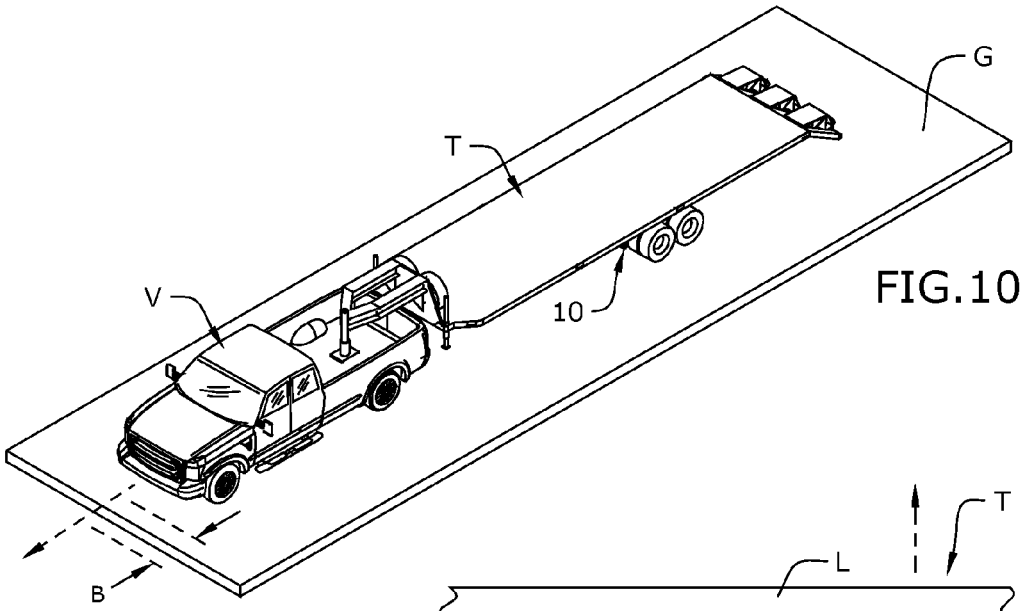
FIG. 10 is a perspective view demonstrating vehicle movement forward distance B.
Figure 11:
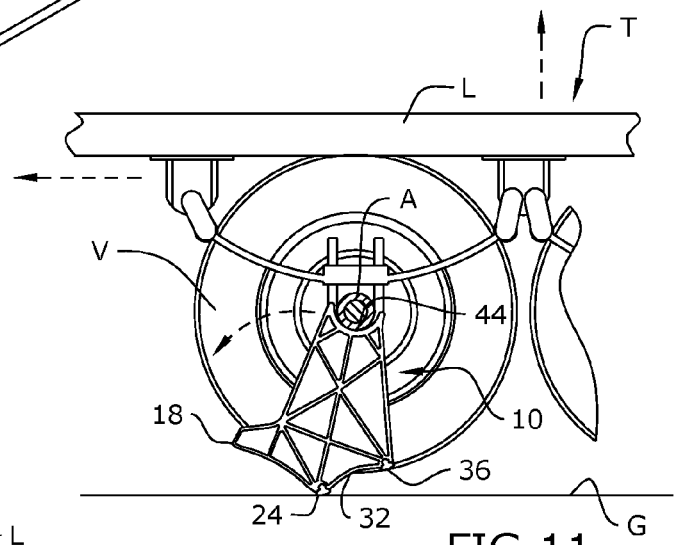
FIG. 11 is a section-detail view of the invention demonstrated mid-rock.
Figure 12:
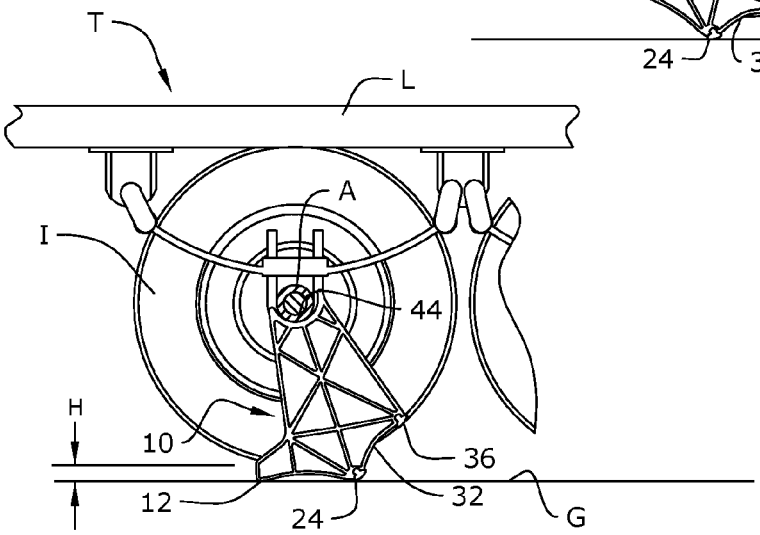
FIG. 12 is a section-detail view of the invention demonstrated post-rock.

By way of example, and referring to FIGS. 1-12, trailer T is pulled by vehicle V a vehicle movement forward distance B. Trailer T comprises load L mechanically coupled to axle A. Axle A is mechanically coupled to at least two tires I. The at least two tires I and vehicle V transit along ground G. Elevating tires I from ground G can be done with axle lifting implement 10.

Turning to FIGS. 1-6, axle lifting implement 10 further comprises front side 12 that slopes downward and outward to first rounded portion 14. First rounded portion 14 rounds into second side 16. Second side 16 slopes downward to base resting point 18. Base resting point 18 is joined to base 20. Base 20 further comprises base slot 28. Base slot 28 is filled with first angular lift surface 24. First angular lift surface 24 further comprises first anti-slip ribbing 26. Between base resting point 18 and base slot 28, base 20 is concave inward. First anti-slip ribbing 26 is configured to prevent axle lifting implement 10 from skidding while in use.

Base slot 28 is joined to relief base 32. Relief base 32 further comprises relief base slot 34. Relief base slot 34 is filled with second angular lift surface 36. Second angular lift surface 36 further comprises second anti-slip ribbing 38. Between base slot 28 and relief base slot 34, relief base 34 is concave inward. Second anti-slip ribbing 38 is configured to prevent axle lifting implement 10 from skidding while in use.

Relief base slot 28 is joined to rear side 40. Rear side 40 contracts toward front side 12 from bottom to top. Rear side 40 is joined to front side 12 with axle cradle 44. Axle cradle 44 is concave inward.

Axle lifting implement 10 disperses the weight of axle A onto base resting point 18, first angular lift surface 24 and second angular lift surface 36 by utilizing internal support frame 46. Internal support frame 46 further comprises first member 50 which joins front side 12 to axle cradle 44. Second member 52 joins rear side 40 to axle cradle 44. Third member 54 joins front side 12 to upper central joint 56. Fourth member 58 joins axle cradle 44 to upper central joint 56. Fifth member 60 joins rear side 40 to upper central joint 56. Sixth member 62 joins first rounded portion 14 to upper central joint 56. Seventh member 64 joins upper central joint 56 to lower central joint 74. Eighth member 66 joins upper central joint 56 to relief base slot 34. Ninth member 68 joins first rounded portion 14 to base 20. Tenth member 70 joins first rounded portion 14 to base slot 28. Eleventh member 72 joins first rounded portion 14 to lower central joint 74. Twelfth member 76 joins lower central joint 74 to base slot 28. Thirteenth member 78 joins lower central joint 74 to relief base slot 34.

Turning to FIG. 7-10, to use axle lifting implement 10, axle cradle 44 is placed beneath axle A. Then, in a first mode of operation, rotating axle lifting implement 10 around axle A such that second angular lift surface 36 is immediately adjacent to ground G. At that point, a user drives vehicle V forward causing first angular lift surface 24 to become immediately adjacent to ground G. By the time vehicle V moves forward a vehicle movement forward distance B, second angular lift surface 36 elevates from ground G, while base resting point 18 moves downward onto ground G in a second mode of operation. This lifts tire I a height H from ground G. In some embodiments, it can be useful to use a plurality of axle lifting implements 10 to lift a trailer. Experimentation has shown that at least two axle lifting implements 10 are needed to lift each axle. This removes the weight of load L from tires I and increases the life of tires I, by transferring weight from second angular lift surface 36 to first angular lift surface 24 and base resting point 18.

This system can be made from many materials in many ways. In some instances, axle lifting implement 10 can be made from plastic using plastic injection molding. In these embodiments, the major axis of axle cradle 44 would need to be between 12 inches and 36 inches long. When internal support frame 46 is properly arranged axle lifting implement 10 can carry a load of 4800 lbf before plastic deformation occurs. In some embodiments, a first distance exists between axle cradle 44 and first angular lift surface 24. A second distance exists between the axle cradle 44 and second angular lift surface 36. Structural strength is increased where the first distance is greater than the second distance.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An axle lifting implement, configured to lift an axle of a vehicle a height above the ground; the axle lifting implement comprising:

a support frame with a part outline integrally formed from a plurality of walls; wherein the support frame comprises:

an axle cradle wall that is concave toward a middle of the part outline for mating with the axle;

a base slot, formed concave into a first corner of the part outline between a first wall and a second wall; a first anti-slip ribbing fitted into and extending out of the base slot to form a first angular lift surface;

a relief base slot, formed concave into a second corner of the part outline between the first wall and a third wall; a second anti-slip ribbing fitted into and extending out of the relief base slot to form a second angular lift surface;

a base resting surface located at a third corner of the part outline between the second wall and a fourth wall;

wherein the first wall that connects the first angular lift surface to the second angular lift surface is concave toward the middle of the part outline;

wherein the second wall that connects the first angular lift surface to the base resting surface is concave toward the middle of the part outline;

wherein the third wall connects the second angular lift surface to one end of the axle cradle wall;

wherein the fourth wall connects the base resting surface to another end of the axle cradle wall;

wherein a first mode of operation the vehicle is supported on the ground and the axle lifting implement is positioned with the axle cradle wall immediately adjacent to the axle such that only the first angular lift surface and the second angular lift surface are in contact with the ground;

wherein when the vehicle is moved in a direction toward the axle lifting implement, while maintaining the axle cradle wall immediately adjacent to the axle, the vehicle movement causes the axle lifting implement to pivot on the first angular lift surface and come to rest in a second mode of operation such that only the first angular lift surface and the base resting surface are in contact with the ground;

wherein in the second mode of operation the vehicle is supported by the axle above the ground.

2. The axle lifting implement of claim 1, wherein the fourth wall further comprises:

a first rounded portion that rounds into a second side wherein the second side slopes downward to the base resting surface.

3. The axle lifting implement of claim 2, further comprising an internal support frame; the internal support frame further comprising:

a first member which joins the first rounded portion to the axle cradle wall;

a second member which joins the third wall to the axle cradle wall; and a third member which joins the first rounded portion to an upper central joint.

4. The axle lifting implement of claim 3, wherein the internal support frame further comprises:

a fourth member which joins the axle cradle wall to the upper central joint;

a fifth member which joins the third wall to the upper central joint; and a sixth member which joins the first rounded portion to the upper central joint.

5. The axle lifting implement of claim 4, wherein the internal support frame further comprises:

a seventh member which joins the upper central joint to a lower central joint;

an eighth member which joins the upper central joint to the relief base slot;

a ninth member which joins the first rounded portion to the second wall;

a tenth member which joins the first rounded portion to the base slot.

6. The axle lifting implement of claim 5, wherein the internal support frame further comprises:

an eleventh member which joins the first rounded portion to the lower central joint;

a twelfth member which joins the lower central joint to the base slot;

a thirteenth member which joins the lower central joint to the relief base slot.

7. The axle lifting implement of claim 1, wherein a first distance exists between the axle cradle wall and the first angular lift surface;

wherein a second distance exists between the axle cradle wall and the second angular lift surface;

wherein structural strength is increased where the first distance is greater than the second distance.

* * * * *